US005342068A

United States Patent [19]

Large

[11] Patent Number: 5,342,068

[45] Date of Patent: Aug. 30, 1994

[54] LAMINAR FLOW VACUUM CHUCK

[75] Inventor: Jeffrey L. Large, McKinney, Tex.

[73] Assignee: Texas Instruments Incorporated, Dallas, Tex.

[21] Appl. No.: 112,744

[22] Filed: Aug. 26, 1993

[51] Int. Cl.[5] ..... B25B 11/00

[52] U.S. Cl. ..... 279/3; 269/21

[58] Field of Search ..... 279/3; 269/20, 21; 51/131.5, 235

[56] References Cited

U.S. PATENT DOCUMENTS 2,443,987 6/1948 Morrison et al. ..... 269/21

FOREIGN PATENT DOCUMENTS 209741 8/1989 Japan ..... 269/21

256677 11/1991 Japan ..... 269/21

*Primary Examiner*—Steven C. Bishop

*Attorney, Agent, or Firm*—John D. Crane; Donaldson, Richard L.

[57] ABSTRACT

A laminar flow vacuum chuck (10) has a plurality of vacuum ports (20, 52) disposed near the center of the chuck. A plurality of interconnected grooves (22, 24, 26, 26, 30, 32, 34, 36, 38, 40, 42, 44, 46, 50, 62, 64) extend from the vacuum ports (20, 52) to the perimeter 14. By reason of the shape of the interconnected grooves and the location of the vacuum ports, the downward force on a wafer supported by the chuck increases as the wafer size increases.

18 Claims, 2 Drawing Sheets

LAMINAR FLOW VACUUM CHUCK

FIELD OF THE INVENTION

The present invention relates to the field of wafer holding chucks for holding wafers during various manufacturing or testing operations and particularly to a laminar flow wafer holding chuck used in manufacturing or testing.

BACKGROUND OF THE INVENTION

The present invention relates to a wafer holding chuck useful for supporting and positioning a wafer during manufacturing or testing thereof. Previously known wafer holding chucks have taken numerous forms. In the simplest case, a flat surface is provided with an aperture at the center to which a vacuum source is applied. A wafer can then be placed on the wafer supporting surface and the vacuum will serve to hold the wafer on the chuck securely. A variation on this design is a chuck having a plurality of openings dispersed around the wafer holding surface so as to provide multiple vacuum ports for more securely holding a wafer to the chuck. Other designs have also been utilized which include one or more grooves cut in the surface of the wafer holding chuck with one or more vacuum ports being formed at the bottom of the grove so as to provide a method for widely distributing the vacuum port when a wafer is placed on the chuck.

The designs heretofore known, however, have not proved to be entirely satisfactory for the purpose of holding wafers and particularly semiconductor wafers during either manufacturing or testing steps. One particular problem frequently encountered with known vacuum chucks is that in some instances they simply do not hold the wafer on the chuck very well. This is particularly noticeable in wafer holding chucks where there are a small number of vacuum ports in the surface of the chuck. In such situations, it has frequently been observed that the wafer simply is not held well enough so as to prevent movement thereof as a result of vibration, shaking or moving the chuck itself.

In overcoming the above difficulty, in some instances manufacturers have suggested using stronger vacuum sources. This in and of itself adds to the cost but it also has a tendency to warp wafers which themselves may be slightly warped when put on the wafer chuck. Accordingly, the cost and the difficulty of adjustment presents further objections to the use of some known designs.

A further difficulty encountered with prior art wafer holding chucks is that adjustment of the operation thereof is not easily accomplished so as to provide the maximum holding power when the largest wafer is mounted on the chuck while having reduced holding power when a small wafer is to be held by the chuck. The inability to adjust the vacuum easily results in warping the wafer being held thereby in many situations. Such warping results in the features on the wafer being stressed which may produce electrical faults in the circuits on the wafer.

SUMMARY OF THE INVENTION

The present invention comprises a vacuum holding chuck which is particularly useful in overcoming the above identified problems of the prior art. The present chuck includes a wafer supporting surface into which a plurality of grooves are cut. A plurality of vacuum ports are also provided in the grooves which provides a means to remove air from the grooves when a wafer is resting on the wafer support surface. The grooves are of a size and shape and the vacuum ports are located so that the hold down force on a wafer supported by the chuck varies as the size of the wafer supported thereby varies.

DESCRIPTION OF THE DRAWINGS

The forgoing and other advantages and features of the present invention will be described below in greater detail in connection with the drawings wherein.

DETAILED DESCRIPTION

Figure 1:
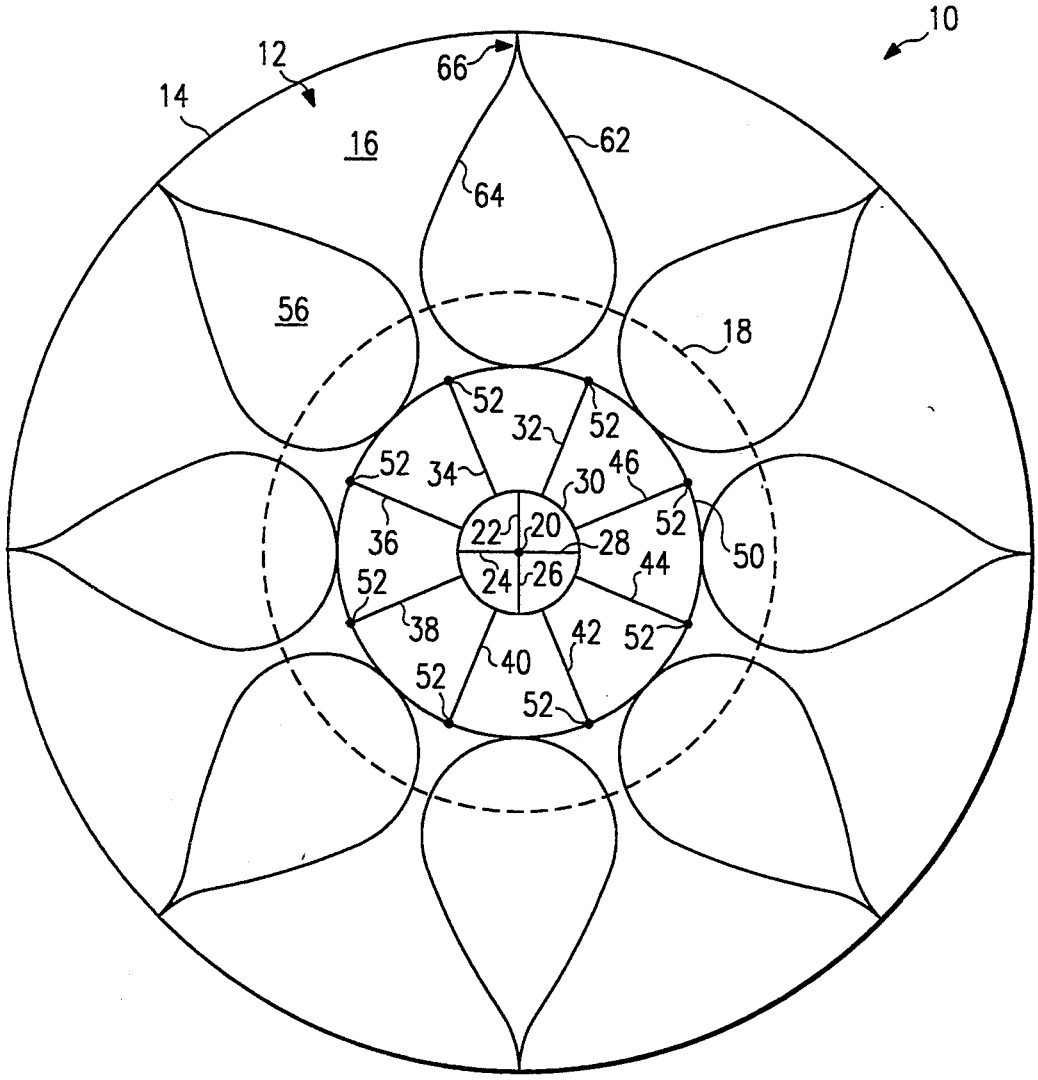
FIG. 1 illustrates a configuration of grooves and vacuum ports which has a plurality of tear shaped areas included between grooves disposed near the perimeter of the chuck.

Referring first to FIG. 1, a vacuum chuck 10 is illustrated having a circular body 12 having a perimeter 14. The circular body 12 may be made of most any suitable material including metal, such as steel, or any other material which can be manufactured with a flat upper surface 16 may be utilized. The upper surface 16 is the surface on which a wafer will rest when the vacuum chuck 10 is in use. The dotted circular line 18 indicates the preferred position of a circular wafer having a diameter approximately one-half the diameter of the circular body 12.

Located at the center of the circular body 12 is a vacuum port or opening 20. This vacuum port 20 is coupled in use to an exterior vacuum source which, when a wafer rests upon the surface 16, will evacuate air from under the wafer and cause a downward pressure upon the wafer to be exerted thereby serving to hold the wafer onto the chuck 10.

Extending radially outward from the vacuum port 20 are four grooves 22, 24, 26 and 28. These grooves, as with all the other grooves to be later described, are typically cut in the upper surface 16 to a maximum depth of approximately $\frac{1}{8}$ inch and to a maximum width of approximately 1/32 of an inch.

The radial grooves 22, 24, 26 and 28 extend outwardly from the vacuum port 20 to a circular grove 30. Extending radially outward from the circular grove 30 are a plurality of radial grooves 32, 34, 36, 38, 40, 42, 44 and 46. The grooves 32–46 extend radially outward from the innermost circular groove 30 to an outermost circular groove 50. Eight vacuum ports 52 are located at the eight intersections of the radial grooves 32–46 with the circular groove 50.

Disposed between the outermost circular groove 50 and the perimeter 14 are a plurality of grooves which, as illustrated in FIG. 1, include generally tear shaped areas such as that at 56. Specifically, a non-radial groove such as illustrated at 62 extends between the outermost circular grove 50 and the perimeter 14. A second non-radial grove 64 extends from the outermost circular grove 50 and joins the non-radial grove 62 at a point indicated by the arrow 66. The connection point between the grove 62 and the groove 64 with the outermost circular groove 50 as illustrated is approximately midway between two vacuum ports 52 and is substantially tangential to the circular groove 50. An alternative configuration would be to have the grooves 62 and 64 join the outermost circular groove 50 at a vacuum port 52. The exact configuration selected is a design choice although it is desirable to select the configuration that minimizes the turbulence of air flow within the grooves during use of the vacuum chuck 10. The portion of the groove 62 between the connection point 66 between groove 62 and groove 64 and the perimeter 14 is illustrated as being substantially radial although this groove portion, as a matter of design choice, does not have to be radial.

Figure 2:
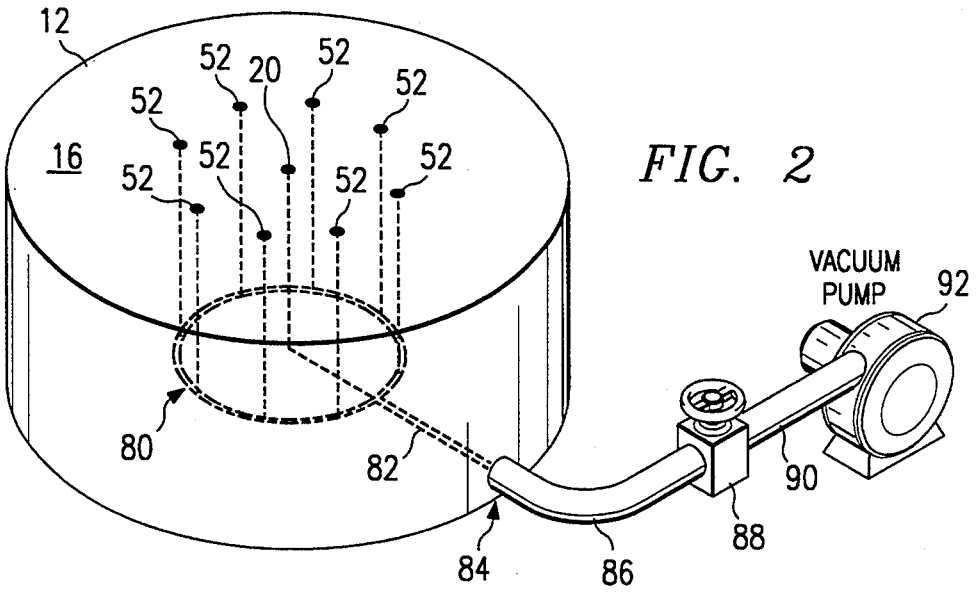
FIG. 2 illustrates a vacuum chuck similar to that of FIG. 1, however, a plurality of triangular shaped areas are disposed between grooves near the perimeter of the chuck.

A similar though alternative arrangement of grooves in a vacuum chuck 10 is illustrated in FIG. 2. In this alternative configuration, the area between the outermost circular groove 50 and the perimeter 14 has a plurality of generally triangular shaped areas such as 70 defined by non-radial grooves 72 and 74 and a portion of the outermost circular groove 50. Each non-radial groove 72 extends from a vacuum port 52 to the perimeter 14. The non-radial groove 74 extends from a different vacuum port 52 to a point along groove 74 indicated by the arrow 76.

It will be evident from the fact that the non-radial grooves extending between the outermost circular groove 50 and perimeter 14 of FIG. 1 and FIG. 2 are different in shape that the included shape between them can take on many forms and that numerous other shapes can be utilized in accordance with the present invention. The particular aspect of this configuration, however, which is important is the fact that each non-radial groove extending outwardly from the outermost circle 50 should join; at least one other non-radial groove to form a groove segment such as illustrated at 80 in FIG. 2 which extends to the perimeter 14. An advantage of this configuration is that it provides an easy means for varying the number of ports to ambient atmosphere provided by the vacuum chuck 10 when a wafer rests on the upper surface. Specifically, when a wafer of the diameter indicated by dotted line 18 rests on the upper surface 16. There are 16 grooves which extend under the surface of the wafer to ambient atmosphere beyond the circumference of the wafer 18. However, if a larger wafer is placed on the upper surface 16 which has a size sufficient that its perimeter will rest on the region of the non-radial grooves which is substantially radial as illustrated at 80, only 8 ports are provided to ambient atmosphere. As a result, a greater downward force which is distributed across the wafer will be exerted on the wafer having the larger diameter than a wafer having a diameter such as illustrated by the circle 18. As such, without any adjustment of the vacuum source, the vacuum chuck of the present invention provides an easy mechanism for varying the distributed downward force on a wafer as a function of the wafer size. Accordingly, a greater down force can be exerted upon larger wafers and a lesser down force exerted on smaller wafers.

While it should be noted that the radial segment 80 has been heretofore specified as being radial in nature, it will be recognized by those of skill in the art that this is not necessarily required. The only requirement is that the non-radial grooves 72 and 74 merge to form a single groove 80 which has merely been illustrated as being radial for exemplary purposes and might very easily be curved or straight, which ever is desired by the designer.

Figure 3:
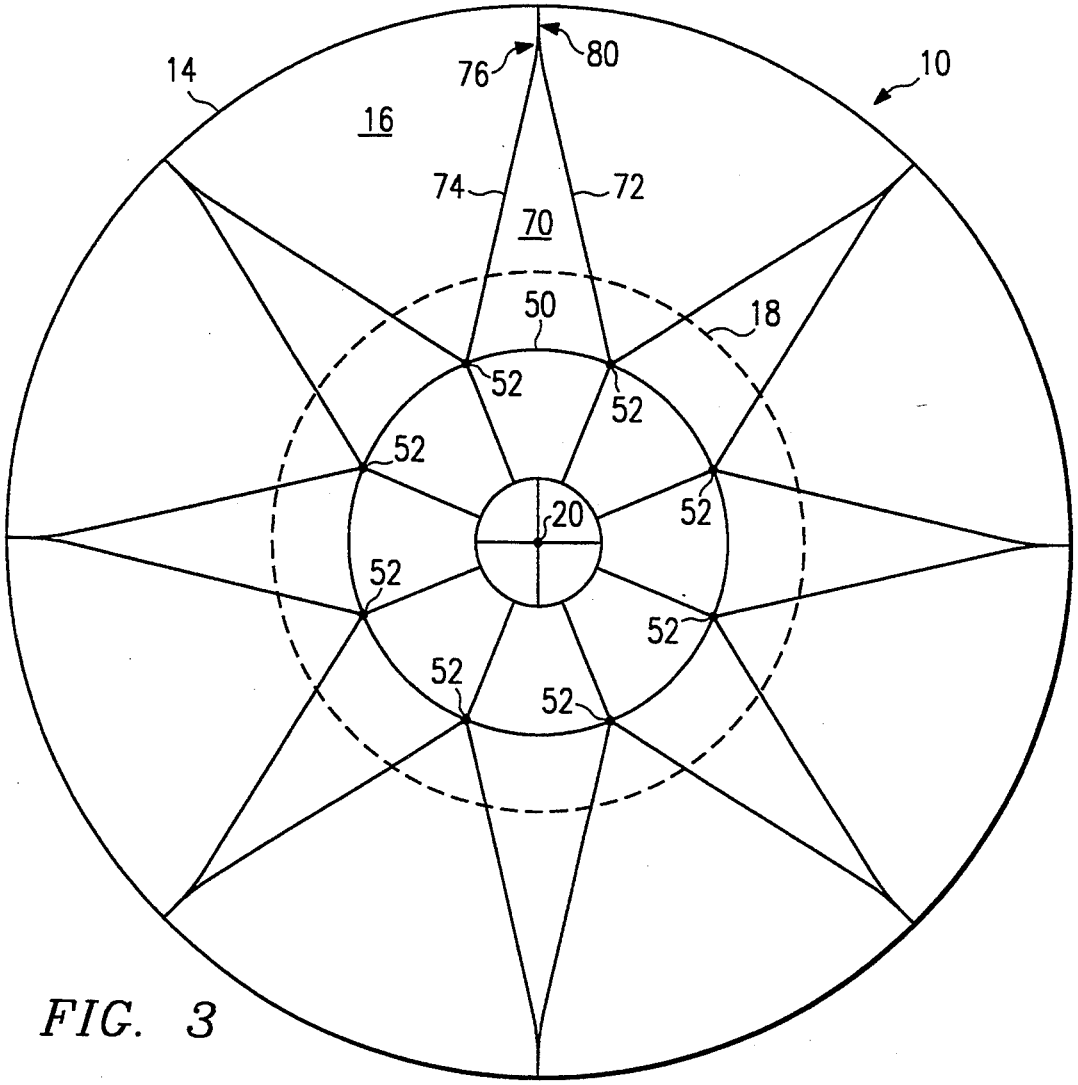
FIG. 3 illustrates a vacuum chuck of the present invention in combination with a vacuum source.

Referring now to FIG. 3, the circular body 12 with its upper surface 16 is illustrated with a centrally located vacuum port 20 and eight vacuum ports 52 disposed symmetrically around the port 20. For ease of illustration, grooves have not been shown in the surface 16 in FIG. 3. Each of the vacuum ports 52 and 20 are coupled by internal passages indicated by the dotted lines at 80 to a common passage 82 which extends from the interior portions of the circular body 12 to an exterior port or opening at 84. A vacuum coupling pipe 86 couples between the port 84 and a control valve 88. An additional vacuum coupling pipe 88 couples between the control valve 88 and a single vacuum source or pump 92. By operating the vacuum pump 92, it is possible to produce air flow at each of the vacuum ports 20 and 52 when ever the valve 88 is open which will tend to remove air from under any wafer resting on the chuck. By controlling the valve 88, it is possible to control the extent of vacuum being produced at each of the vacuum ports 20 and 52. In this fashion, a single control valve 88 can serve to control the downward force on a wafer resting on the upper surface 16.

While the forgoing description has been made with particular emphasis on the preferred embodiments of the present invention, those of skill in the art will readily recognize that alternative configurations can be utilized without departing from the spirit and scope of the invention as defined in the following claims.

What is claimed is:

1. A vacuum chuck for holding and supporting wafers of varying diameter comprising, in combination:

a wafer support for supporting a wafer and having an upper surface and a perimeter, said upper surface being at least as large as the wafer to be supported;

a plurality of interconnected grooves disposed in said upper surface with a plurality of vacuum ports disposed in said grooves, said grooves extending to said perimeter of said wafer support, said grooves being of a size and shape and said vacuum ports being positioned in said grooves to provide a plurality of ports to ambient which varies in number as a function of wafer size and causes the hold down force on the wafer to increase with wafer size.

2. The vacuum chuck of claim 1 wherein each said vacuum port is coupled to a common passage which, in use, is coupled to a single vacuum source.

3. The vacuum chuck of claim 2 additionally including a vacuum producing means coupled to said common passage.

4. The vacuum chuck of claim 1 wherein at least some of said grooves include a generally triangular shaped area.

5. The vacuum chuck of claim 1 wherein at least some of said grooves include a tear shaped area.

6. A vacuum chuck for holding and supporting wafers of varying size comprising, in combination:

a wafer support having an upper surface and a perimeter;

a plurality of vacuum ports disposed in said upper surface; and a plurality of interconnected grooves disposed in said upper surface interconnecting all said vacuum ports, at least some of said grooves being both non-circular and non-radial which interconnect between other said grooves, at least some of said grooves extending to said perimeter to provide a port to ambient atmosphere regardless of the size of the wafer supported on said upper surface.

7. The vacuum chuck of claim 6 including a vacuum source coupled to said vacuum ports.

8. The vacuum chuck of claim 6 wherein said vacuum ports are distributed symmetrically in said upper surface.

9. The vacuum chuck of claim 7 including control means to control the level of vacuum coupled to said vacuum ports.

10. The vacuum chuck of claim 9 wherein the number of ports to ambient atmosphere varies with the size of the wafer resting on said upper surface.

11. A vacuum chuck for holding and supporting wafers of varying size comprising, in combination:

a wafer support having an upper surface and a perimeter;

an innermost and an outermost circular groove in said upper surface disposed substantially concentrically with each other and having different diameters;

a centrally located vacuum port;

a plurality of radial grooves extending from said centrally located vacuum port to said innermost circular groove;

a plurality of vacuum ports disposed along said outermost circular groove;

a plurality of radial grooves each extending from said outermost circular groove to said innermost circular groove; and a plurality of non-radial grooves extending outward from said outermost circular groove toward said perimeter, each said non-radial groove merging with at least one other said non-radial groove near said perimeter to form a single groove which extends to said perimeter.

12. The vacuum chuck of claim 11 wherein said non-radial grooves are symmetrically disposed in said upper surface and include a plurality of generally tear shaped areas.

13. The vacuum chuck of claim 11 wherein said wafer support has an interior common channel coupled to each said vacuum port for providing a single vacuum port at the exterior of said support which, in use, can be connected to a single vacuum source.

14. The vacuum chuck of claim 11 additionally including a single vacuum source coupled to all of said vacuum ports.

15. The vacuum chuck of claim 11 wherein said grooves are symmetrically positioned with respect to said centrally located vacuum port.

16. The vacuum chuck of claim 11 wherein said grooves are shaped and positioned to minimize air flow turbulence at the intersection between grooves.

17. The vacuum chuck of claim 14 additionally including means to control the level of vacuum coupled to said vacuum ports.

18. The vacuum chuck of claim 11 wherein at least some of said vacuum ports are equally spaced along said outermost circular groove.

* * * * *